US008087169B2

(12) United States Patent
Kanemitsu et al.

(10) Patent No.: US 8,087,169 B2
(45) Date of Patent: Jan. 3, 2012

(54) METHOD OF MANUFACTURING SHEET METAL BACK FACE PULLEY

(75) Inventors: Toshiaki Kanemitsu, Hyogo (JP); Kunihiro Harada, Hyogo (JP); Naoki Fujii, Hyogo (JP)

(73) Assignee: Kanemitsu Corporation, Ookurahonmachi, Akashi-shi, Hyogo (JP)

( * ) Notice: Subject to any disclaimer, the term of this patent is extended or adjusted under 35 U.S.C. 154(b) by 1225 days.

(21) Appl. No.: 11/791,790

(22) PCT Filed: Dec. 10, 2004

(86) PCT No.: PCT/JP2004/018470
§ 371 (c)(1),
(2), (4) Date: May 29, 2007

(87) PCT Pub. No.: WO2006/061908

PCT Pub. Date: Jun. 15, 2006

(65) Prior Publication Data

US 2008/0022527 A1 Jan. 31, 2008

(51) Int. Cl.
*B21K 1/42* (2006.01)
*B21H 1/18* (2006.01)

(52) U.S. Cl. ..... 29/892.11; 29/892; 29/892.2; 29/892.3; 72/82

(58) Field of Classification Search ..... 29/892, 29/892.11, 892.2, 892.3; 72/71, 82, 83, 84, 72/85

See application file for complete search history.

(56) References Cited

U.S. PATENT DOCUMENTS

| | | | | |
|---|---|---|---|---|
| 4,273,547 | A * | 6/1981 | Bytzek | 474/170 |
| 4,524,595 | A * | 6/1985 | Oda | 72/84 |
| 4,631,946 | A * | 12/1986 | Oda | 72/68 |
| 4,749,375 | A * | 6/1988 | Guevel et al. | 474/170 |
| 4,831,705 | A * | 5/1989 | Kanemitsu | 29/892.11 |
| 5,537,850 | A | 7/1996 | Inatani | |
| 5,941,113 | A * | 8/1999 | Kanemitsu et al. | 72/82 |
| 6,381,847 | B1 * | 5/2002 | Kanemitsu et al. | 29/892.3 |
| 6,691,542 | B2 * | 2/2004 | Fukukawa et al. | 72/84 |
| 6,745,453 | B1 * | 6/2004 | Kanemitsu et al. | 29/557 |

FOREIGN PATENT DOCUMENTS

| | | |
|---|---|---|
| JP | 1087020 | 3/1989 |
| JP | 2001/343062 | 12/2001 |
| JP | 2002/035878 | 5/2002 |
| WO | WO 98 05 447 | 2/1998 |
| WO | WO/0166278 A1 | 9/2001 |

OTHER PUBLICATIONS

Official Action dated Apr. 10, 2010 in corresponding European Application EP04822544.

* cited by examiner

*Primary Examiner* — Rick Chang
*Assistant Examiner* — Sarang Afzali
(74) *Attorney, Agent, or Firm* — Bacon & Thomas, PLLC

(57) ABSTRACT

A sheet metal-made cup-shaped material including a circular base plate portion and a cylindrical portion extends from an outer peripheral edge portion of the base plate portion in one direction along the axis of the base plate portion. An annular groove is formed in an upper end portion of the cylindrical portion, whereby an annular projection that projects in a direction opposite to a direction along which the cylindrical portion extends is formed in the cylindrical portion. The annular projection and the cylindrical portion are clampingly pressed to a degree at which the annular groove at least disappears, whereby the outer circumferential face of the projection and the outer circumferential face of the cylindrical portion are flush with each other. Therefore, the axial length of a sheet metal-made back face pulley is increased, and the whole of the increased axial length can be used as the effective length.

8 Claims, 8 Drawing Sheets

METHOD OF MANUFACTURING SHEET METAL BACK FACE PULLEY

The present invention relates to a method of producing a back face pulley made of a sheet metal, and more particularly to a method of producing a sheet metal-made back face pulley in which the effective length of a cylindrical portion that is to be in contact with the back face of a belt to support the back face of the belt can be increased.

BACKGROUND ART

Conventionally, a sheet metal-made back face pulley which causes a cylindrical portion to be in contact with the back face of a belt to function as, for example, a tensioner is known. The applicant of the present application has disclosed a production method in which the length of the cylindrical portion is increased (elongated) (Patent Literature 1).

In the production method in which the length of the cylindrical portion is increased (elongated), as shown in the left half of FIG. 8, a sheet metal-made cup-shaped material 4 comprising: a circular base plate portion 2 from which a boss portion 1 is projected; and a cylindrical portion 3 which extends from an outer peripheral portion of the base plate portion 2 in one direction along the axis C1 of the base plate portion 2 is prepared. A rotary lower mold 5 is fitted from a lower open-end portion of the cup-shaped material 4, and a shaft portion 51 of the mold is fitted into the boss portion 1. A downward expansion 21 which is formed in the base plate portion 2 is fitted into a recess 52 of the rotary lower mold 5, so that the cup-shaped material 4 is set to the rotary lower mold 5 so as to be radially immovable, and a rotary upper mold 6 is opposed to the upper side of the rotary lower mold 5 via the base plate portion 2.

Then, the rotary upper mold 6 is lowered as indicated by the arrow e in the right half of FIG. 8, and a downward expansion 61 of the mold is fitted to the upper face of the downward expansion 21 of the base plate portion 2, so that the base plate portion 2 of the cup-shaped material 4 is clampingly held by the upper end face of the rotary lower mold 5 and the lower end face of the rotary upper mold 6. Thereafter, at least one of the rotary lower mold 5 and the rotary upper mold 6 is rotated about the axis C1 to rotate the rotary lower mold 5, the rotary upper mold 6, and the cup-shaped material 4 about the axis C1. In this way, while rotating the cup-shaped material 4, a first roll-forming roller 7 is moved in the direction of the arrow f, and a portion corresponding to an approximately lower half of the cylindrical portion 3 is clampingly pressed by a pressing face 71 which protrudes radially outward, and the outer circumferential face 53 of the rotary lower mold 5. This causes the portion corresponding to the approximately lower half of the cylindrical portion 3, to be downward extended as indicated by the reference numeral 8 while the approximately lower half of the cylindrical portion 3 is thinned.

As shown in the left half of FIG. 9, next, the cup-shaped material 4 in which the portion 8 corresponding to the approximately lower half of the cylindrical portion 3 is downward extended while being thinned is set to a rotary lower mold 5*a* so as to be radially immovable, and a rotary upper mold 6*a* is opposed to the upper side of the rotary lower mold 5*a* via the base plate portion 2. In this case, the rotary lower mold 5*a* which is slightly smaller in diameter than the rotary lower mold 5 used in FIG. 8 is used. Therefore, a small gap s is formed between the outer circumferential face 53*a* of the rotary lower mold 5*a* and the cylindrical portion 3. A cutaway 62 which allows ingress of an outer peripheral edge of an upper end portion of a second roll-forming roller that will be described later is formed in an outer peripheral edge portion of the rotary upper mold 6*a*. In the rotary lower mold 5*a* and rotary upper mold 6*a* which are shown in FIG. 9, portions corresponding to those of the rotary lower mold 5 and rotary upper mold 6 which are shown in FIG. 8 are denoted by the same reference numerals.

Then, the rotary upper mold 6*a* is lowered as indicated by the arrow g in the right half of FIG. 9, and a downward expansion 61 of the mold is fitted to the upper face of the downward expansion 21 of the base plate portion 2, so that the base plate portion 2 of the cup-shaped material 4 is clampingly held by the upper end face of the rotary lower mold 5*a* and the lower end face of the rotary upper mold 6*a*. Thereafter, at least one of the rotary lower mold 5*a* and the rotary upper mold 6*a* is rotated about the axis C1 to rotate the rotary lower mold 5*a*, the rotary upper mold 6*a*, and the cup-shaped material 4 about the axis C1. In this way, while rotating the cup-shaped material 4, a second roll-forming roller 9 is moved in the direction of the arrow h, and a thick portion 3*a* (see the left half of FIG. 9) corresponding to an approximately upper half of the cylindrical portion 3 is clampingly pressed by a pressing face 91 which is recessed radially inward, and the outer circumferential face 53*a* of the rotary lower mold 5*a*. This causes the thick portion 3*a* to be downward extended as indicated by the reference numeral 10 in the right half of FIG. 9 while being thinned, with the result that the cylindrical portion 3 in which the outer circumferential face is flat can be produced.

Namely, by the cup-shaped material 4 in which the thickness t1 of the cylindrical portion 3 shown in FIG. 10 is large and the axial length h1 of the cylindrical portion 3 is small, the cylindrical portion 3 in which, as shown in FIG. 11, the thickness t2 is small and the axial length h2 is larger than the axial length h1 in FIG. 9 can be produced.

Patent Literature 1: WO98/05447

DISCLOSURE OF THE INVENTION

Problems to be Solved by the Invention

However, the conventional method of enlarging a cylindrical portion is merely a method of further extending the cylindrical portion 3 which extends in one direction along the axis C1 of the base plate portion 2, to the same direction, and not a technique for extending an upper end portion of the cylindrical portion 3. In the method, the upper end portion of the cylindrical portion 3 is curved, and hence the back face of a belt cannot be in contact with the curvature outer circumferential face of the portion.

Therefore, an effective length h3 of the cylindrical portion 3 with which the back face of a belt can be in contact is limited to a value which is obtained by subtracting the axial length Δh of the upper-end curved portion 11*b* of the cylindrical portion 3 from the axial length h2 of the cylindrical portion 3.

The invention solves this problem. It is an object of the invention to provide a method of producing a sheet metal-made back face pulley in which, unlike the prior art, the effective length of an upper-end curved portion of a cylindrical portion with which the back face of a belt can be in contact is not reduced, but the effective length can be increased.

Means for Solving the Problems

The method of producing a sheet metal-made back face pulley according to the invention is characterized in that a sheet metal-made cup-shaped material comprising: a circular base plate portion; and a cylindrical portion which extends from an outer peripheral edge portion of the base plate portion in one direction along an axis of the base plate portion is prepared, an upper end portion of the cylindrical portion is pressed by a groove-forming protrusion disposed in a roll-forming roller, to form an annular groove in the upper end portion of the cylindrical portion, whereby an annular projection that projects in a direction opposite to a direction along which the cylindrical portion extends is formed in the cylindrical portion, and the groove, the projection, and the cylindrical portion are clampingly pressed by a rotary inner mold and a flat-face forming rolling roller to a degree at which the groove at least disappears, whereby an outer circumferential face of the projection, and an outer circumferential face of the cylindrical portion are formed to be flush with each other.

Effects of the Invention

According to the production method, the upper end portion of the cylindrical portion in the sheet metal-made cup-shaped material is pressed by the groove-forming protrusion disposed in the roll-forming roller, to form the annular groove, whereby the annular projection that projects in the direction opposite to the direction along which the cylindrical portion extends is formed in the cylindrical portion. As a result, the axial length of the sheet metal-made cup-shaped material is larger than the original length (original dimension) correspondingly with the projection distance of the annular projection. The groove, projection, and cylindrical portion of the sheet metal-made cup-shaped material in which the axial length has been made larger than the original dimension as described above are clampingly pressed by the rotary inner mold and the flat-face forming rolling roller to a degree at which the groove at least disappears, so that the outer circumferential face of the projection, and the outer circumferential face of the cylindrical portion are formed to be flush with each other, whereby the axial length is further increased. Therefore, it is possible to produce a sheet metal-made back face pulley in which the whole of the increased axial length can be used as the effective length. Since the whole of the increased axial length can be used as the effective length, for example, it is possible to attain an effect that a small positional displacement in the width direction of a belt is absorbed, and a stable contact state with the back face of the belt can be maintained.

In the production method of the invention, preferably, the flat-face forming rolling roller is prepared in at least plural kinds, and the outer circumferential face of the projection and the outer circumferential face of the cylindrical portion are formed in plural steps to be flush with each other.

When plural steps are conducted as described above, a time required in one step is shorter than the case where the outer circumferential face of the projection and the outer circumferential face of the cylindrical portion are formed at one stroke in one step to be flush with each other. In a production line, therefore, a sheet metal-made back face pulley in which the outer circumferential face of the projection and the outer circumferential face of the cylindrical portion are sequentially formed during the time of the one short step, to be flush with each other, and the production efficiency can be enhanced. Describing in more detail, in the production method in which the outer circumferential face of the projection and the outer circumferential face of the cylindrical portion are formed to be flush with each other by one step where the single flat-face forming rolling roller is used, namely, the time required in one step is prolonged, and the production number of the production line per unit time is determined by the prolonged time required in one step. By contrast, in the production method in which the outer circumferential face of the projection and the outer circumferential face of the cylindrical portion are formed to be flush with each other by plural steps where plural kinds of flat-face forming rolling rollers are used, the time required in each of the steps is shortened. Therefore, the production number of the production line per unit time can be increased correspondingly with the shortened time required in each of the steps, and the production efficiency can be enhanced.

In the production method of the invention, preferably, the groove is formed within a range of a thickness of the cylindrical portion.

According to the configuration, the groove does not enter the base plate portion, and it is possible to prevent a disadvantage that the base plate portion is thinned to reduce its strength, from occurring. Therefore, reduction of the buckling strength of the base plate portion can be avoided.

In the production method of the invention, preferably, the groove-forming protrusion having a V-like section shape is used, and the projection is projected while a bottom of the groove is positioned approximately on a center line of an axial thickness of the base plate portion.

According to the configuration, the projection distance of the projection can be sufficiently ensured while preventing the projection from being thinned.

DESCRIPTION OF REFERENCE NUMERALS

Figure 1:
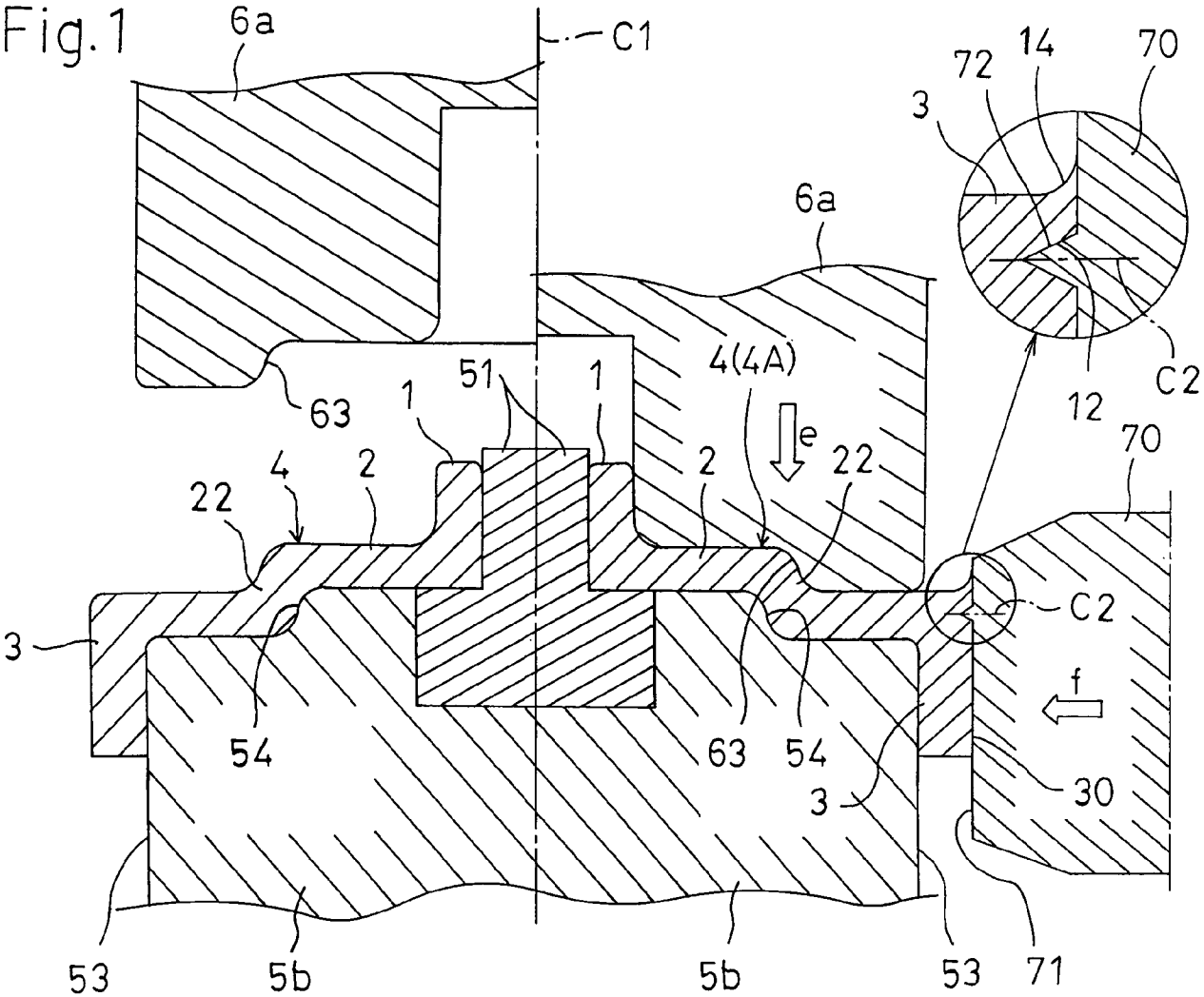
FIG. 1 is a longitudinal sectional view showing a step of forming a small V-like groove in a sheet metal-made cup-shaped material which is applied to an embodiment of the invention.

2 circular base plate portion
3 cylindrical portion
4 sheet metal-made cup-shaped material
15 projection
15*a* outer circumferential face of projection 15

BEST MODE FOR CARRYING OUT THE INVENTION

Hereinafter, a preferred embodiment of the method of producing a sheet metal-made back face pulley according to the invention will be described with reference to the drawings. In the embodiment, the components which are identical with those of the conventional example that has been described with reference to FIG. 8, FIG. 9, FIG. 10, and FIG. 11 will be described by denoting them with same reference numerals.

Figure 4:
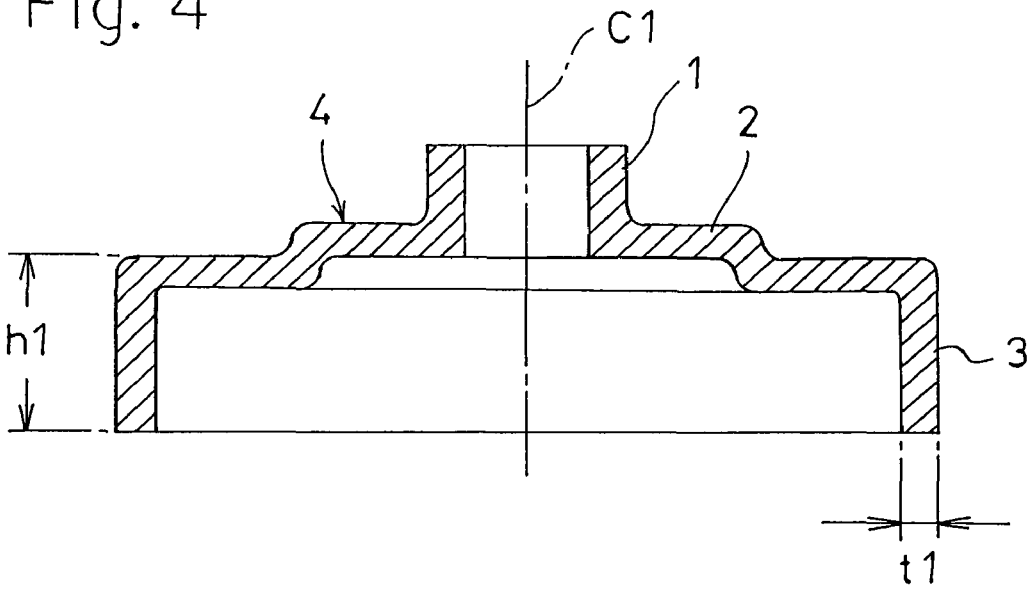
FIG. 4 is a longitudinal sectional view showing an example of the sheet metal-made cup-shaped material which is applied to the embodiment of the invention.

As shown in the left half of FIG. 1 and FIG. 4, the embodiment uses the cup-shaped material 4 comprising: the circular base plate portion 2 from which the boss portion 1 where the axis C1 is set as the center axis is projected; and the cylindrical portion 3 which extends from an outer peripheral portion of the base plate portion 2 in one direction along the axis C1 of the base plate portion 2. In the circular base plate portion 2, a higher portion on the side of the boss portion 1 is continuous to a lower portion on the side of the cylindrical portion 3 via an annular stepped portion 22.

As shown in the left half of FIG. 1, the cup-shaped material 4 is fitted from the lower open end portion of the material onto a rotary lower mold 5*b*, the boss portion 1 of the cup-shaped material 4 is fitted onto a shaft 51 of the rotary lower mold 5*b*, and an annular stepped face 54 of the rotary lower mold 5*b* is fitted to the inner face of the annular stepped portion 22 disposed in the base plate portion 2, so that the cup-shaped material 4 is set to the rotary lower mold 5*b* so as to be radially immovable. Thereafter, the rotary upper mold 6*a* is opposed to the upper side of the rotary lower mold 5*b* via the base plate portion 2.

Then, the rotary upper mold 6*a* is lowered as indicated by the arrow e in the right half of FIG. 1, and the annular stepped portion 22 of the base plate portion 2 is fitted to an annular stepped face 63 formed in the lower end of the rotary upper mold 6*a*, so that the base plate portion 2 of the cup-shaped material 4 is clampingly held by the upper end face of the rotary lower mold 5*b* and the lower end face of the rotary upper mold 6*a*. Thereafter, at least one of the rotary lower mold 5*b* and the rotary upper mold 6*a* is rotated about the axis C1 to rotate the rotary lower mold 5*b*, the rotary upper mold 6*a*, and the cup-shaped material 4 about the axis C1.

While rotating the cup-shaped material 4 in this way, a first roll-forming roller 70 is moved in the direction of the arrow f, so that a first groove-forming protrusion 72 having a small V-like section shape which is protruded radially outward in the vicinity of an upper end portion of the first roll-forming roller 70 is pressed radially inward into an upper end portion of the cylindrical portion 3, and the cylindrical-portion pressing face 71 of the first roll-forming roller 70 is caused to butt against the outer circumferential face 30 of the cylindrical portion 3. While the first roll-forming roller 70 reversely rotates with following the rotation of the cup-shaped material 4, therefore, a cup-shaped material 4A is molded in which an annular first groove 12 that is small opened in a V-like shape is formed in an outer peripheral edge of the upper end portion of the cylindrical portion 3, and an annular projection 14 that small projects in the direction opposite to the direction along which the cylindrical portion 3 extends is formed in the cylindrical portion 3.

Figure 2:
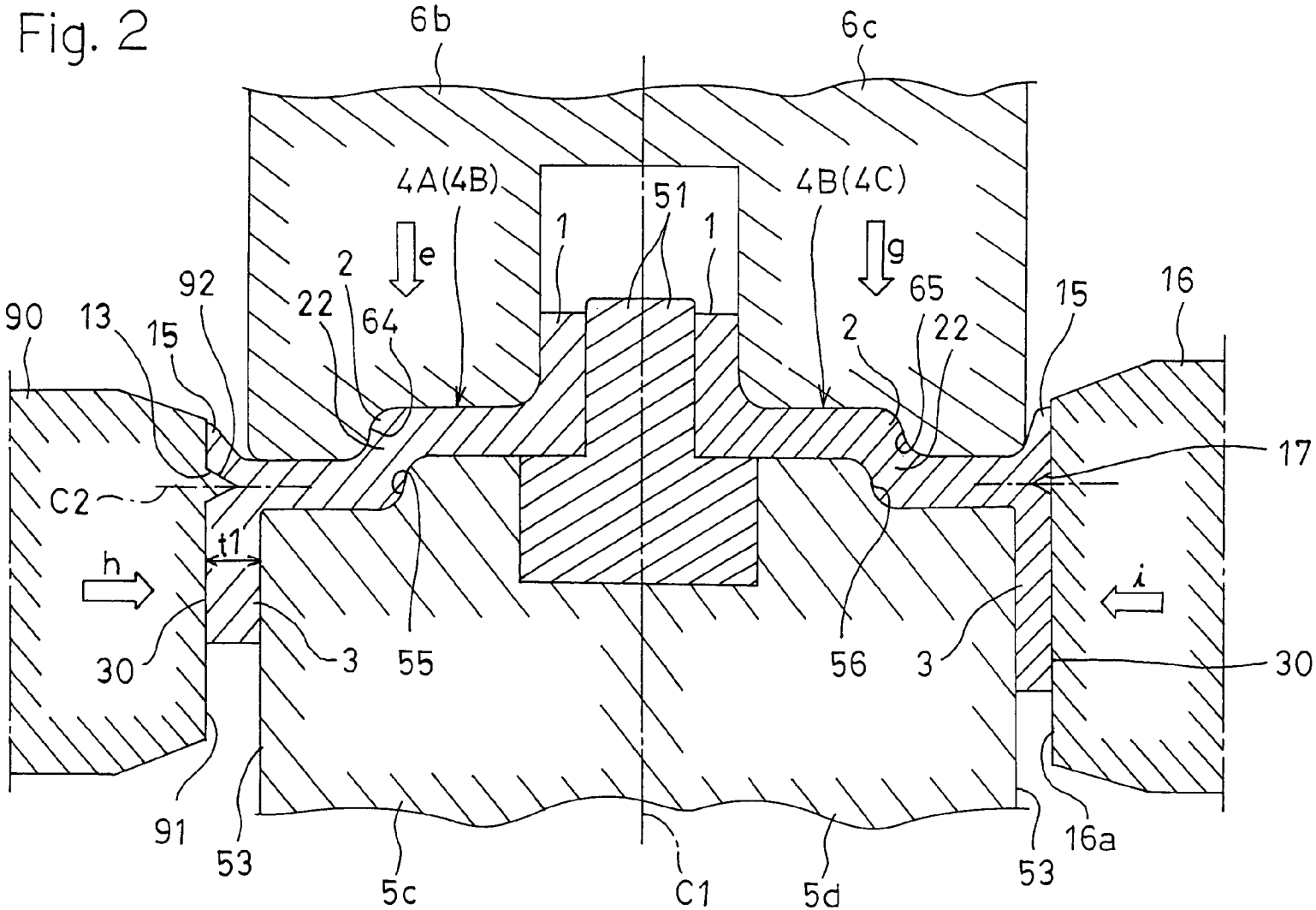
FIG. 2 is a longitudinal sectional view showing a step of forming a large V-like groove in the sheet metal-made cup-shaped material which is worked in FIG. 1.

As shown in the left half of FIG. 2, next, the cup-shaped material 4A in which the annular first groove 12 and the annular projection 14 are formed is fitted from a lower open end portion of the material onto a rotary lower mold 5*c*, and the boss portion 1 of the cup-shaped material 4A is fitted onto the shaft 51 of the rotary lower mold 5*c*. An annular stepped face 55 of the rotary lower mold 5*c* is fitted to the inner face of the annular stepped portion 22 disposed in the base plate portion 2, so that the cup-shaped material 4A is set to the rotary lower mold 5*c* so as to be radially immovable. Then, the rotary upper mold 6*b* is lowered as indicated by the arrow e, and the annular stepped portion 22 of the base plate portion 2 is fitted to an annular stepped face 64 formed in the lower end of the rotary upper mold 6*b*, so that the base plate portion 2 of the cup-shaped material 4 is clampingly held by the upper end face of the rotary lower mold 5*c* and the lower end face of the rotary upper mold 6*b*. At least one of the rotary lower mold 5*c* and the rotary upper mold 6*b* is rotated about the axis C1 to rotate the rotary lower mold 5*c*, the rotary upper mold 6*b*, and the cup-shaped material 4A about the axis C1.

A second roll-forming roller 90 is moved in the direction of the arrow h with respect to the cup-shaped material 4A which rotates about the axis C1 together with the rotary lower mold 5*c* and the rotary upper mold 6*b* as described above, whereby a second groove-forming protrusion 92 having a large V-like section shape which is protruded radially outward in the vicinity of an upper end portion of the second roll-forming roller 90 is fitted into the annular first groove 12 (see the right half of FIG. 1) which has been already small opened in a V-like shape, to be pressed radially inward, and the cylindrical-portion pressing face 91 is caused to butt against the outer circumferential face 30 of the cylindrical portion 3. While the second roll-forming roller 90 reversely rotates with following the rotation of the cup-shaped material 4A, therefore, a cup-shaped material 4B is molded in which the annular first groove 12 that has been already formed is pressed open by the second groove-forming protrusion 92 to form an annular second groove 13 that is largely opened in a V-like shape, and an annular projection 15 that largely projects in the direction opposite to the direction along which the cylindrical portion 3 extends is formed in the cylindrical portion 3.

The annular projection 15 is formed in this way, whereby the axial length of the cup-shaped material 4B is further increased correspondingly with the projection distance of the annular projection 15 than the original length (original dimension) of the sheet metal-made cup-shaped material 4 shown in the left half of FIG. 1.

As shown in the right half of FIG. 2, next, the cup-shaped material 4B in which the annular second groove 13 and the annular projection 15 are formed is fitted from a lower open end portion of the material onto a rotary lower mold 5*d*, and the boss portion 1 of the cup-shaped material 4B is fitted onto the shaft 51 of the rotary lower mold 5*d*. An annular stepped face 56 of the rotary lower mold 5*d* is fitted to the inner face of the annular stepped portion 22 disposed in the base plate portion 2, so that the cup-shaped material 4B is set to the rotary lower mold 5*d* so as to be radially immovable. Then, the rotary upper mold 6*c* is lowered as indicated by the arrow g, and the annular stepped portion 22 of the base plate portion 2 is fitted to an annular stepped face 65 formed in the lower end of the rotary upper mold 6*c*, so that the base plate portion 2 of the cup-shaped material 4B is clampingly held by the upper end face of the rotary lower mold 5*d* and the lower end face of the rotary upper mold 6*c*. At least one of the rotary lower mold 5*d* and the rotary upper mold 6*c* is rotated about the axis C1 to rotate the rotary lower mold 5*d*, the rotary upper mold 6*c*, and the cup-shaped material 4B about the axis C1.

A first flat-face forming rolling roller 16 is moved in the direction of the arrow i with respect to the cup-shaped material 4B which rotates about the axis C1 together with the rotary lower mold 5*c* and the rotary upper mold 6*b* as described above, so that the cylindrical portion 3 and the annular projection 15 are clampingly pressed by the outer circumferential face 16*a* of the first flat-face forming rolling roller 16, the outer circumferential face 53 of the rotary lower mold 5*d*, and the outer circumferential face of a lower end portion of the rotary upper mold 6C, whereby a cup-shaped material 4C is molded in which the annular second groove 13 (see the left half of FIG. 2) is deformed to a state where a small groove 17 remains, the length is slightly larger than that in the axis C1 of the cylindrical portion 3 of the cup-shaped material 4B shown in the left half of FIG. 2, and the thickness is smaller than that of the cylindrical portion 3 of the cup-shaped material 4B shown in the left half of FIG. 2.

Figure 3:
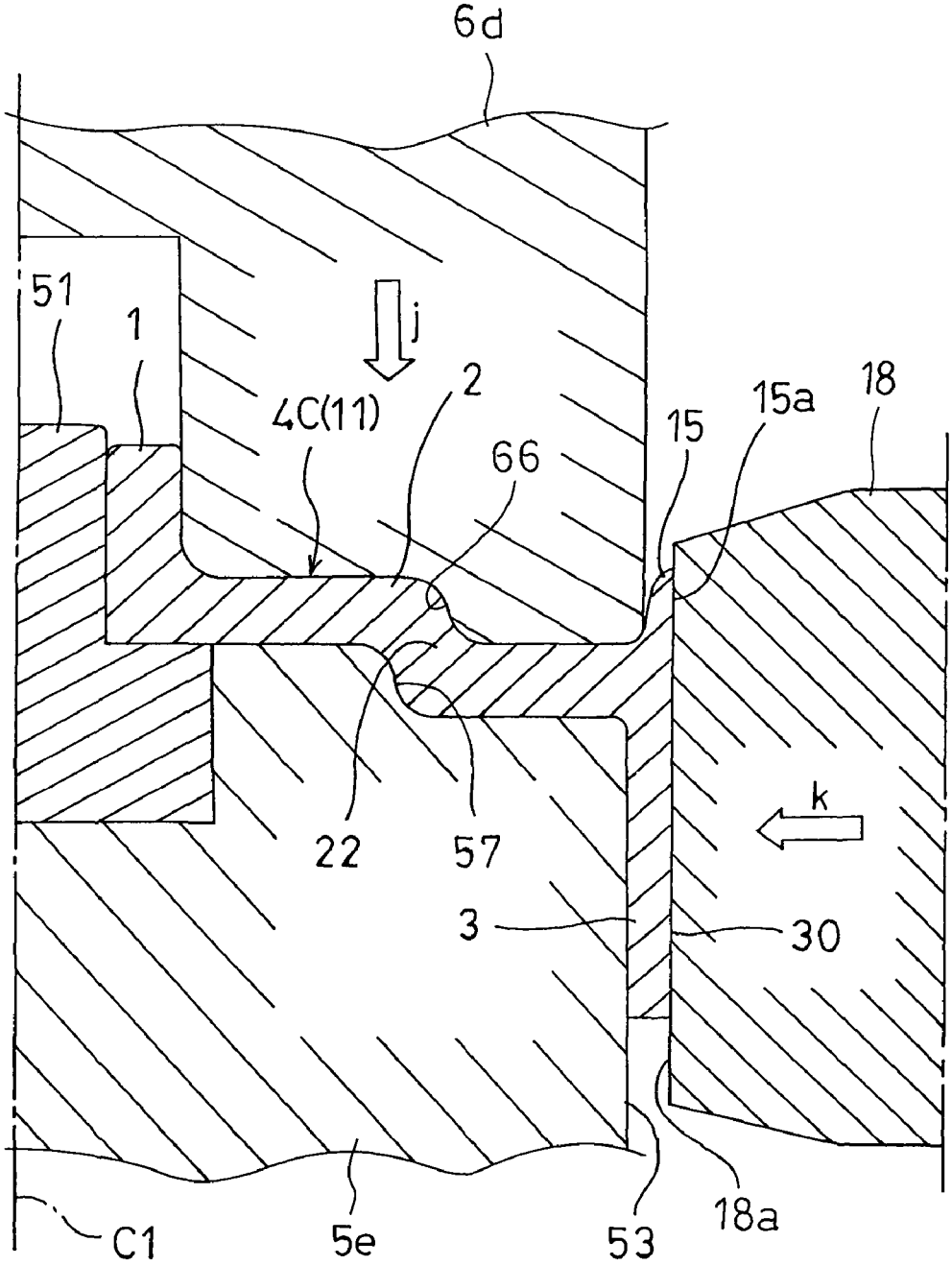
FIG. 3 is a half-cutaway longitudinal sectional view showing a step of, in the sheet metal-made cup-shaped material which is worked in FIG. 2, forming an annular projection in a direction opposite to a direction along which the cylindrical portion extends, to form the outer circumferential face of the projection to be flush with the outer circumferential face of the cylindrical portion.

As shown in FIG. 3, next, the cup-shaped material 4C is fitted from a lower open end portion of the material onto a rotary lower mold 5*e*, and the boss portion 1 of the sheet metal-made cup-shaped material 4C is fitted onto the shaft 51 of the rotary lower mold 5*e*. An annular stepped face 57 of the rotary lower mold 5*e* is fitted to the inner face of the annular stepped portion 22 disposed in the base plate portion 2, so that the cup-shaped material 4B is set to the rotary lower mold 5*e* so as to be radially immovable. Then, the rotary upper mold 6*d* is lowered as indicated by the arrow j, and the annular stepped portion 22 of the base plate portion 2 is fitted to an annular stepped face 66 formed in the lower end of the rotary upper mold 6*d*, so that the base plate portion 2 of the cup-shaped material 4C is clampingly held by the upper end face of the rotary lower mold 5*e* and the lower end face of the rotary upper mold 6*d*. Thereafter, at least one of the rotary lower mold 5*e* and the rotary upper mold 6*d* is rotated about the axis C1 to rotate the rotary lower mold 5*e*, the rotary upper mold 6*d*, and the cup-shaped material 4C about the axis C1.

A second flat-face forming rolling roller 18 is moved in the direction of the arrow k with respect to the cup-shaped material 4C which rotates about the axis C1 together with the rotary lower mold 5*e* and the rotary upper mold 6*d* as described above, so that the cylindrical portion 3 and the annular projection 15 are clampingly pressed by the outer circumferential face 18*a* of the second flat-face forming rolling roller 18, the outer circumferential face 53 of the rotary lower mold 5*e*, and the outer circumferential face of a lower end portion of the rotary upper mold 6*d* until the remaining small groove 17 (see the right half of FIG. 2) disappears, whereby the outer circumferential face 15*a* of the annular projection 15, and the outer circumferential face 30 of the cylindrical portion 3 are formed to be flush with each other, and the annular projection 15 is upward extended while being thinned so that the projection distance of the projection is larger than that shown in the right half of FIG. 2, and the cylindrical portion 3 shown in the right half of FIG. 2 is downward extended while being thinned as shown in FIG. 3. Therefore, a sheet metal-made back face pulley 11 in which the axial length is further increased can be produced.

Figure 5:
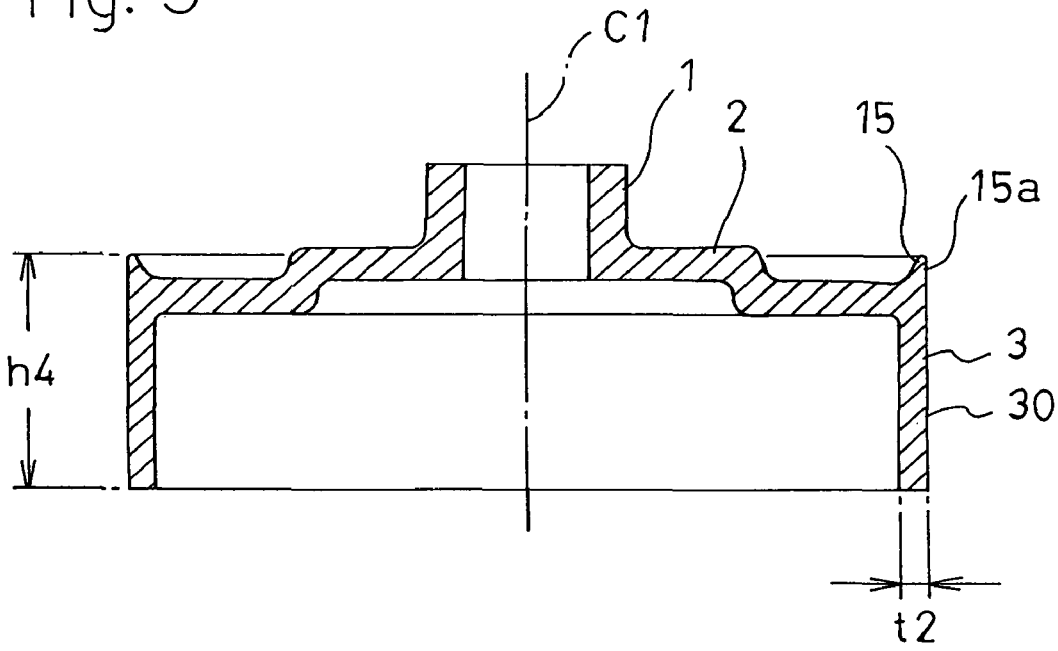
FIG. 5 is a longitudinal sectional view showing a sheet metal-made back face pulley which is produced by the sheet metal-made cup-shaped material of FIG. 4.

Namely, the sheet metal-made back face pulley 11 in which, as shown in FIG. 3 and FIG. 5, the thickness t2 of the cylindrical portion 3 is small, the axial length h4 is increased more than the axial length h1 of FIG. 4, and the whole of the increased axial length h4 can be used as the effective length can be produced by the sheet metal-made cup-shaped material 4 in which the thickness t1 of the cylindrical portion 3 shown in the left half of FIG. 1 and FIG. 4 is large and the axial length h1 is small. Since the whole of the increased axial length h4 can be used as the effective length, for example, an effect that a small positional displacement in the width direction of a belt is absorbed, and a stable contact state with the back face of the belt can be maintained is attained.

In the embodiment, the outer circumferential face 15*a* of the annular projection 15, and the outer circumferential face 30 of the cylindrical portion 3 are formed to be flush with each other, in the two steps using the two kinds of flat-face forming rolling rollers 16, 18, or the first flat-face forming rolling roller 16 and the second flat-face forming rolling roller 18. In a production line for the sheet metal-made back face pulley 11, therefore, the production number per unit time can be increased, and the production efficiency can be enhanced. Namely, in a production method in which the outer circumferential face 15*a* of the annular projection 15, and the outer circumferential face 30 of the cylindrical portion 3 are formed at one stroke so as to be flush with each other in one step using one flat-face forming rolling roller 16, the required time T1 per step is prolonged, and the production number of the production line per unit time (for example, one hour) is determined by the prolonged time required in one step. By contrast, in the production method of the embodiment in which the outer circumferential face 15*a* of the annular projection 15, and the outer circumferential face 30 of the cylindrical portion 3 are formed to be flush with each other in the two steps using the two kinds of flat-face forming rolling rollers 16, 18, the required time T2 per step is shortened to about ½ of the time T1. Therefore, the production number of the production line per unit time (for example, one hour) can be increased correspondingly with the shortened required time T2 per each of the steps, and the production efficiency can be enhanced.

In a production method in which three or more kinds of flat-face forming rolling rollers are prepared and the outer circumferential face 15*a* of the annular projection 15, and the outer circumferential face 30 of the cylindrical portion 3 are formed to be flush with each other in three or more steps, the required time T3 per step is shortened to about ⅓ or more of the time T1. Therefore, the production number of the production line per unit time (for example, one hour) can be further increased correspondingly with the shortened required time T3 per each of the steps, and the production efficiency can be further enhanced.

When, as shown in the left half of FIG. 2, the annular second groove 13 is formed within the range of the thickness t1 of the cylindrical portion 3 of the cup-shaped material 4, the annular second groove 13 does not enter the base plate portion 2, and it is possible to prevent an disadvantage that the base plate portion 2 is thinned to reduce its strength, from occurring. Therefore, reduction of the buckling strength of the base plate portion 2 can be avoided.

When, in the first roll-forming roller 70, the first groove-forming protrusion 72 having a V-like section shape is used as shown in the right half of FIG. 1, and the first groove-forming protrusion 72 is pressed radially inward, the bottom of the annular first groove 12 is positioned approximately on the center line C2 of the axial thickness of the base plate portion 2. Thereafter, when, in the second roll-forming roller 90, the second groove-forming protrusion 92 having a V-like section shape is used as shown in the left half of FIG. 2, and the second groove-forming protrusion 92 is pressed into the annular first groove 12, so that the bottom of the annular second groove 13 is positioned on the center line C2, whereby, in the cylindrical portion 3, a large thickness of a portion which is upper than the center line C2 is ensured. The portion in which a large thickness is ensured is projected in the direction opposite to the direction along which the cylindrical portion 3 extends, and the annular projection 15 can be formed. Therefore, the projection distance in the direction opposite to the direction along which the cylindrical portion 3 extends can be sufficiently ensured while preventing the annular projection 15 from being thinned, and the length h4 (see FIG. 5) from the upper end of the base plate portion 2 of the sheet metal-made back face pulley 11 to the lower end of the cylindrical portion 3 can be increased.

Figure 6:
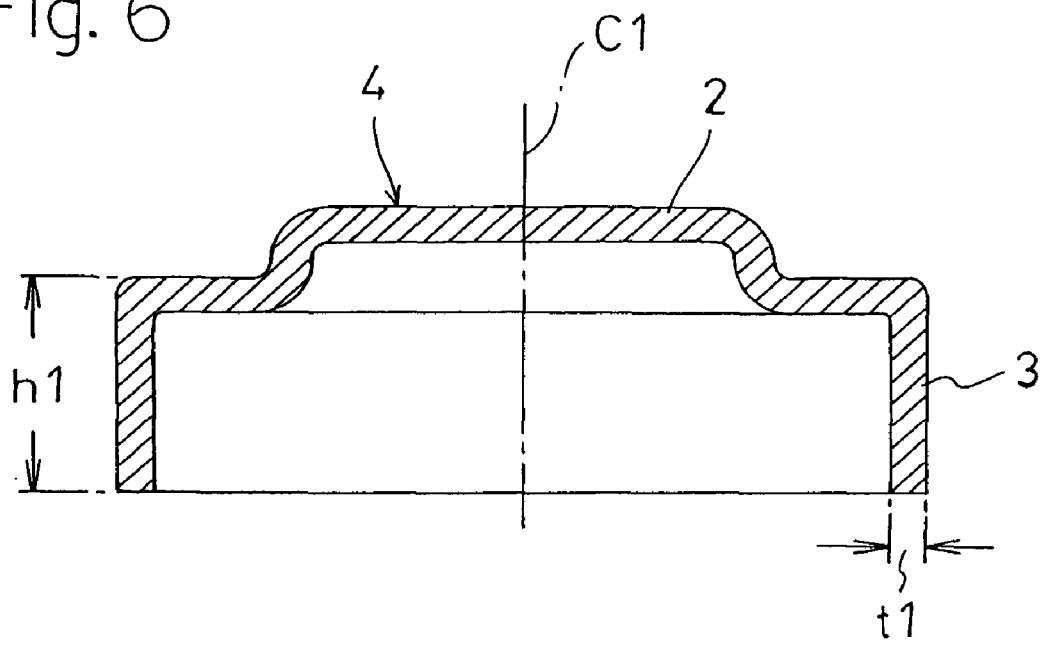
FIG. 6 is a longitudinal sectional view showing another example of the sheet metal-made cup-shaped material.
Figure 7:
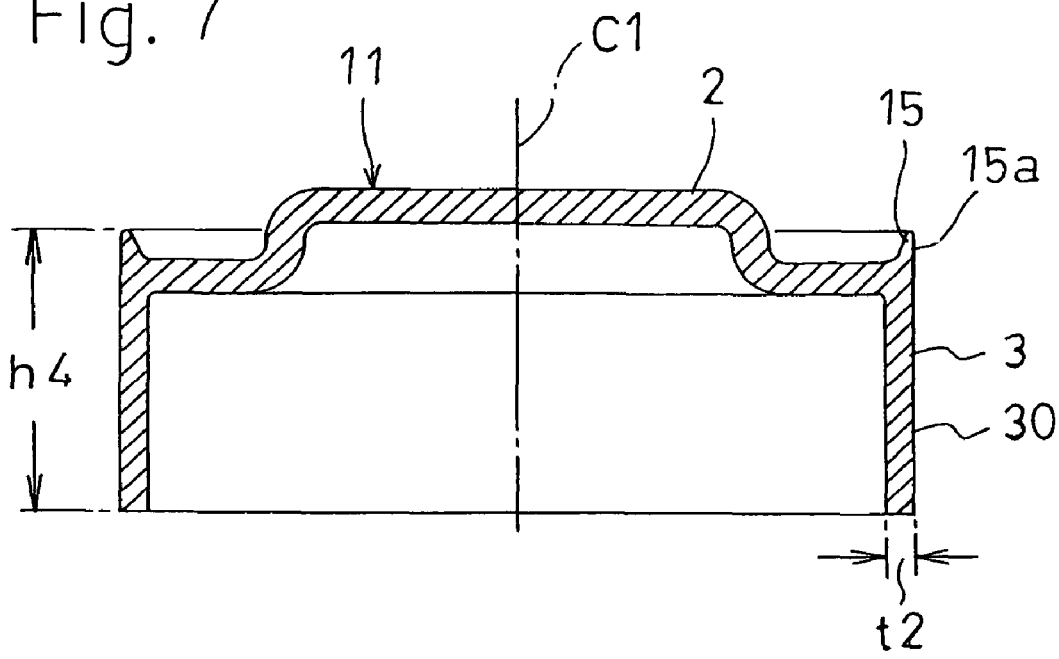
FIG. 7 is a longitudinal sectional view showing a sheet metal-made back face pulley which is produced by the sheet metal-made cup-shaped material of FIG. 6.
Figure 8:
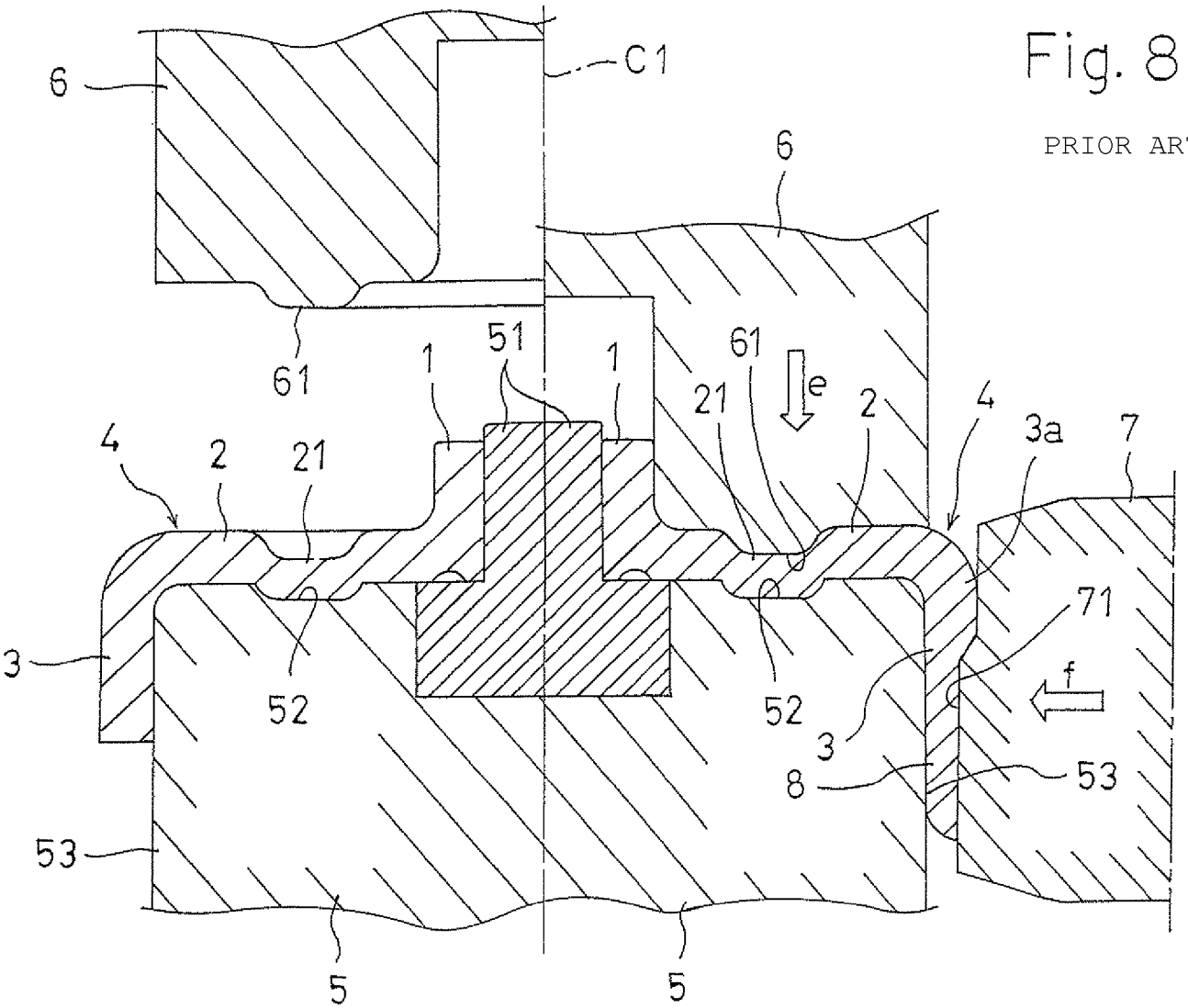
Fig. 8 PRIOR ART
FIG. 8 is a longitudinal sectional view showing a first working stage of extending a cylindrical portion of a conventional sheet metal-made cup-shaped material.
Figure 9:
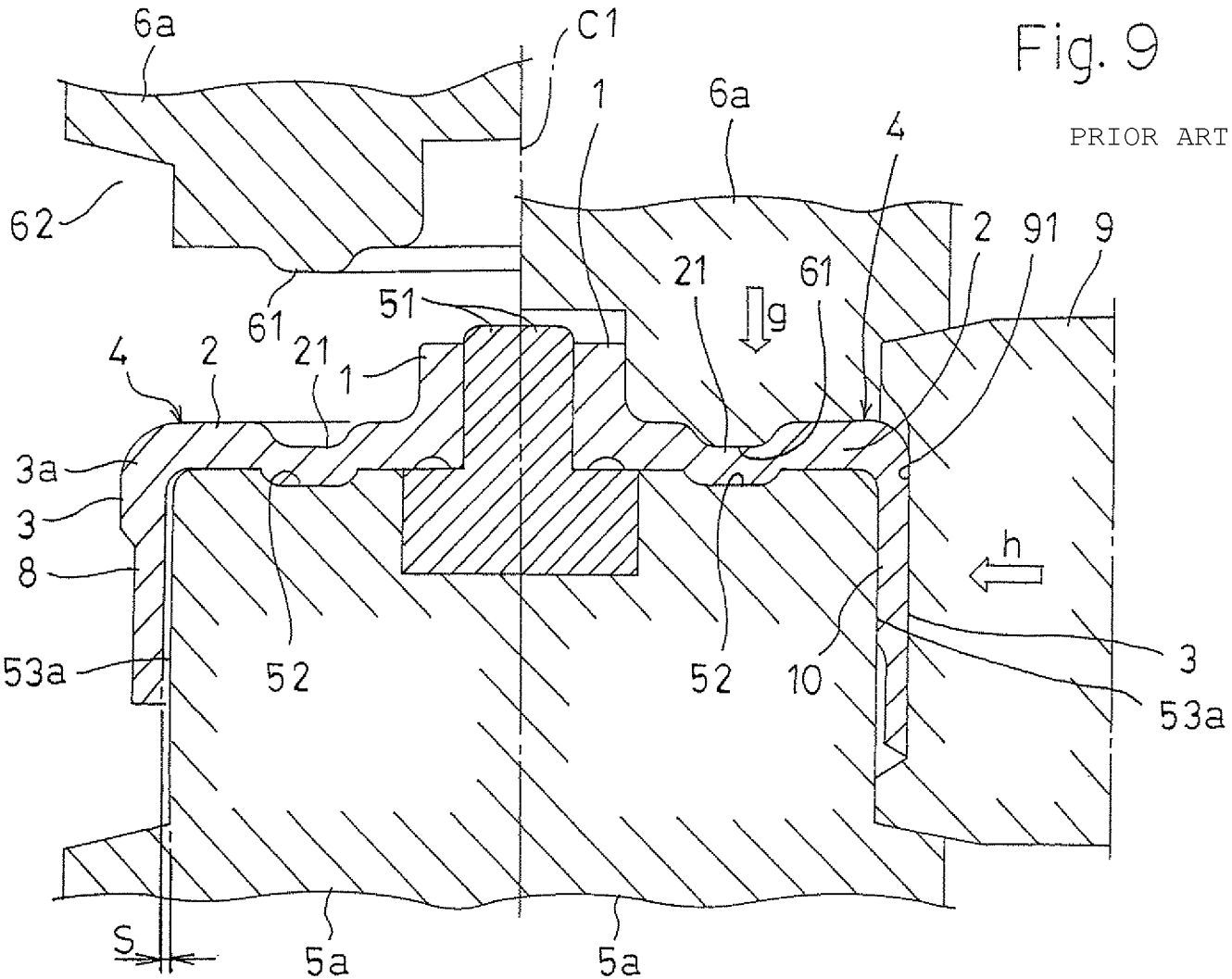
Fig. 9 PRIOR ART
FIG. 9 is a longitudinal sectional view showing a second working stage of further extending the cylindrical portion of the conventional sheet metal-made cup-shaped material which is worked in FIG. 8.
Figure 10:
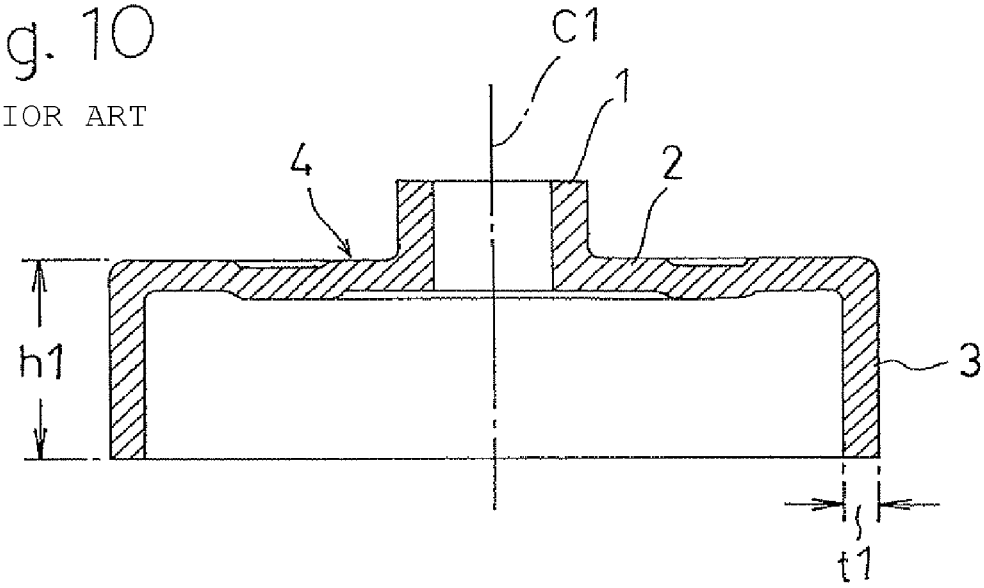
Fig. 10 PRIOR ART
FIG. 10 is a longitudinal sectional view of a sheet metal-made cup-shaped material which is used in a conventional production method.
Figure 11:
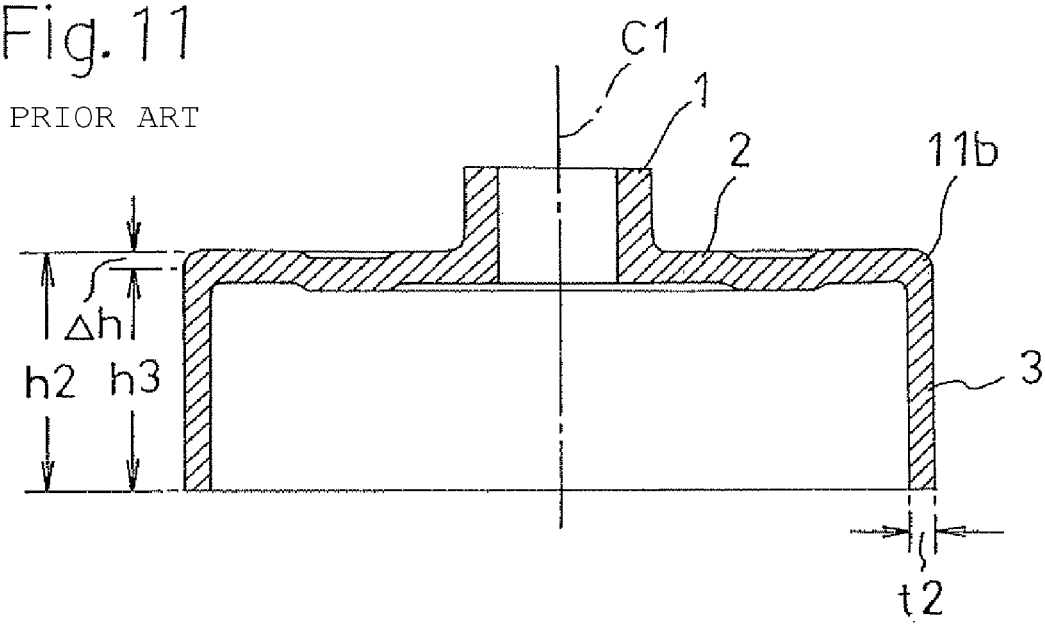
Fig. 11 PRIOR ART
FIG. 11 is a longitudinal sectional view showing a state where a cylindrical portion of the sheet metal-made cup-shaped material of FIG. 10 is extended in one direction.

In the embodiment, the method in which the sheet metal-made back face pulley 11 shown in FIG. 5 is produced by the sheet metal-made cup-shaped material 4 comprising: the circular base plate portion 2 from which the boss portion 1 shown in FIG. 4 is projected; and the cylindrical portion 3 which extends from the outer peripheral portion of the base plate portion 2 in one direction along the axis C1 of the base plate portion 2 has been described. When rotary lower molds different from the rotary lower molds 5*b*, 5*c*, 5*d*, 5*e* used in the embodiment are used, and rotary upper molds different from the rotary upper molds 6*a*, 6*b*, 6*c*, 6*d* used in the embodiment are used, for example, the sheet metal-made back face pulley 11 in which, as shown in FIG. 7, the thickness t2 of the cylindrical portion 3 is small, the axial length h4 is larger than the axial length h1 in FIG. 6, and the whole of the increased axial length h4 can be used as the effective length can be produced as shown in, for example, FIG. 6 by the sheet metal-made cup-shaped material 4 comprising: the circular base plate portion 2 from which the boss portion 1 (see FIG. 4) is omitted; and the cylindrical portion 3 which extends from the outer peripheral portion of the base plate portion 2 in one direction along the axis C1 of the base plate portion 2.

INDUSTRIAL APPLICABILITY

As described above, the invention is the technique in which, in a sheet metal-made cup-shaped material comprising: a circular base plate portion; and a cylindrical portion which extends from an outer peripheral edge portion of the base plate portion in one direction along an axis of the base plate portion, an upper end portion of the cylindrical portion is pressed by a groove-forming protrusion disposed in a roll-forming roller, whereby an annular groove is formed in the upper end portion of the cylindrical portion, to form an annular projection that projects in a direction opposite to a direction along which the cylindrical portion extends, in the cylindrical portion, and the annular groove, the annular projection, and the cylindrical portion are clampingly pressed by a rotary inner mold and a flat-face forming rolling roller to a degree at which the annular groove disappears, and the outer circumferential face of the annular projection, and the outer circumferential face of the cylindrical portion are formed to be flush with each other, so that the axial length of the cylindrical portion is increased, and the whole of the increased axial length can be used as the effective length.

The invention claimed is:

1. A method of producing a sheet metal-made back face pulley wherein a sheet metal-made cup-shaped material comprising: a circular base plate portion; and a cylindrical portion which extends from an outer peripheral edge portion of said base plate portion in one direction along an axis of said base plate portion is prepared, an upper end portion of said cylindrical portion is pressed by a groove-forming protrusion disposed in a roll-forming roller, to form an annular groove in said upper end portion of said cylindrical portion, whereby an annular projection that projects in a direction opposite to a direction along which said cylindrical portion extends is formed in said cylindrical portion, and said groove, said projection, and said cylindrical portion are clampingly pressed by a rotary inner mold and a flat-face forming rolling roller to a degree at which said groove at least disappears, whereby an outer circumferential face of said projection, and an outer circumferential face of said cylindrical portion are formed to be flush with each other.

2. A method of producing a sheet metal-made back face pulley according to claim 1, wherein said outer circumferential face of said projection and said outer circumferential face of said cylindrical portion are formed in plural steps to be flush with each other, each of said steps using a different said flat-face forming rolling roller.

3. A method of producing a sheet metal-made back face pulley according to claim 2, wherein said groove is formed within a range of a thickness of said cylindrical portion.

4. A method of producing a sheet metal-made back face pulley according to claim 3, wherein said groove-forming protrusion having a V-like section shape is used, and said projection is projected while a bottom of said groove is positioned approximately on a center line of an axial thickness of said base plate portion.

5. A method of producing a sheet metal-made back face pulley according to claim 2, wherein said groove-forming protrusion having a V-like section shape is used, and said projection is projected while a bottom of said groove is positioned approximately on a center line of an axial thickness of said base plate portion.

6. A method of producing a sheet metal-made back face pulley according to claim 1, wherein said groove is formed within a range of a thickness of said cylindrical portion.

7. A method of producing a sheet metal-made back face pulley according to claim 6, wherein said groove-forming protrusion having a V-like section shape is used, and said projection is projected while a bottom of said groove is positioned approximately on a center line of an axial thickness of said base plate portion.

8. A method of producing a sheet metal-made back face pulley according to claim 1, wherein said groove-forming protrusion having a V-like section shape is used, and said projection is projected while a bottom of said groove is positioned approximately on a center line of an axial thickness of said base plate portion.

* * * * *